US006280086B1

(12) United States Patent
Stijns

(10) Patent No.: US 6,280,086 B1
(45) Date of Patent: Aug. 28, 2001

(54) TELESCOPIC RAIL WITH STOP BLOCK

(75) Inventor: Andreas Petronella Maria Stijns, Bunde (NL)

(73) Assignee: Thomas Regout B.V., Bunde (NL)

( * ) Notice: Subject to any disclaimer, the term of this patent is extended or adjusted under 35 U.S.C. 154(b) by 0 days.

(21) Appl. No.: 09/142,331

(22) PCT Filed: Jan. 8, 1997

(86) PCT No.: PCT/NL97/00008

§ 371 Date: Jan. 11, 1999

§ 102(e) Date: Jan. 11, 1999

(87) PCT Pub. No.: WO98/30130

PCT Pub. Date: Jul. 16, 1998

(51) Int. Cl.[7] ..... F16C 29/04
(52) U.S. Cl. ..... 384/18
(58) Field of Search ..... 384/118, 115, 384/111, 113, 114

(56) References Cited

FOREIGN PATENT DOCUMENTS 375 252 A 7/1984 (AT) .
30 05 817 9/1980 (DE) .
195 38 101 4/1997 (DE) .

*Primary Examiner*—Lenard A. Footland
(74) *Attorney, Agent, or Firm*—Weingarten, Schurgin, Gagnebin & Hayes LLP

(57) ABSTRACT

A telescopic rail comprising at least two substantially C-shaped sections of which a first section (1) is slidably mounted in a second section (2) with interposition of a first ball cage (3), whereby a stop block (5) is positioned in said second section, in front of the first ball cage seen in the direction of extension of the rail, the stop block having first resilient means (9) near the side facing the first ball cage which can be brought into contact with a first inward facing projection (18) on the first section upon extension of the rail, and second resilient means (8) on the opposite side of the stop block which can be brought into contact with a second inward facing projection (17) on the first section upon retraction of the rail, the first (18) and second (17) projections being located on opposite sides of the first ball cage when the rail is fully retracted, the first projection being movable past the first ball cage.

4 Claims, 6 Drawing Sheets

TELESCOPIC RAIL WITH STOP BLOCK

The invention relates to a telescopic rail including at least two substantially C-shaped sections of which a first section is slidably mounted in a second section with interposition of a first ball cage. Such a telescopic rail is generally known and offered for sale by Thomas Regout BV, Netherlands.

This known telescopic rail comprises first and second section, slidable mounted to each other with an interpositioned ball cage. The first section is movable relative to the second section, thereby extending or retracting the rail between a fully extended first position and a fully retracted second position. Two of such rails are used as a pair for suspension of for example a drawer in a cabinet. In order to prevent damage to the rails, the drawer or the cabinet and to prevent noise generation when the rails reach the first or second position, buffer means are provided on the ball cage and the first and second sections. The first section is provided with an inward extending tab near the front and the rear of the section. The second section is provided with at least an inward facing tab near the end of the second section. A plastic or rubber buffer element is positioned on the rearward tab of the second section. The ball cage is furthermore provided on each end with a second buffer element.

When the rail is in the fully extended first position the front tab of the second section is in abutment with the front buffer element on the ball cage, the rearward tab of the first section in abutment with the rear buffer element of the ball cage. When the rail is in the fully retracted second position the rear tab of the first section is in abutment with the rear buffer element of the second section.

This known telescopic rail has the disadvantage that the first ball cage has to be provided with said buffer elements, as well as at least one of said tabs, which is time consuming and costly. Assembling this known telescopic rail is relatively difficult. The buffer elements are difficult to reach when the rail is in use, which can be a disadvantage, for example for maintenance. Furthermore, the first and second sections have to be relatively long in order to provide for tabs near the rear end of the first and second sections, on the opposite side of the ball cage from the first tab and furthermore since a locking mechanism has to be positioned at the rearward end of the sections. Therefore a relatively large amount of material is necessary and relatively much space for movement of the rail, which means that the rail is relatively heavy and needs a large building volume.

One object of the invention is to provide a telescopic rail in which the said problems are avoided, without loss of the advantages thereof.

The stop block according to the invention incorporates in itself the buffer elements for both the fully retracted as the fully extended position, co-operating with the first and second projections on the first section. The first inward facing projection, that is the projection nearest to the rear of the rail can be brought forward over about the length of the first ball cage in comparison to the known telescopic rail with a similar extension length. The first section can therefore be relatively short. Furthermore only the stop block has to be positioned within the second section in order to obtain both buffer functions. Since the ball cage has no essential buffer or stop function in a telescopic rail according to the invention, the buffer elements on the ball cage can be dispensed with, as can the buffer elements on the tabs. Assembling a telescopic rail according to the invention is easy. The first section is, together with the ball cage, slid into the second section, and the stop block is connected to the second section. The first projection can be formed prior to assembly, the second projection either prior to or after assembly, depending on the flexibility of the stop block and the mode of attachment thereof. When the stop block is sufficiently flexible the first tab on the first section can be pushed over the stop block, deforming the stop block resiliently. The said tab can not pass the stop block in the opposite direction. Either way only assembling steps have to be performed near the front side of the rail, which enables quick and easy assemblage.

A ball cage has to be interpreted in this application as bearing means provided in raceways on the respective rail sections. These ball cages can be constituted as separate series of balls, for example embedded in strips, a strip positioned in each race way or as series of balls embedded in a cage comprising two rows of balls, one for each raceway, the rows being interconnected by a connecting part. Furthermore ball cages can comprise sliding means besides or instead of balls.

At least one guide projection stabilizes and supports the first section relative to the second section, especially in a partly or fully extended position. The or each projection prevents relative movement of the first to the second section in a direction inclined to the direction of extension and retraction. Furthermore the projections can have a stabilizing function for the stop block relative to the second and/or first section. Preferably the stop block is provided with two guide projections, one in the upper and one in the lower raceways of the first and second sections. Furthermore, the stop block centers the first and second sections relative to eachother.

Known three section telescopic rails have an inward facing tab near the front as well as near the rear of the third section, at least the rearward one being provided with a resilient plastic or rubber buffer element. The second ball cage between the second and third section in these known rails is again provided with a second buffer element on the front and rear side thereof. In the fully extended position of the rail the front buffer element of the ball cage is in abutment with the front tab of the third section while the rearward buffer element of the second ball cage is in abutment with the rearward tab of the second section. In this known telescopic rail the distance over which the second section can move relative to the third section is thus determined by the distance between the front and rear tab on the third section and the length of the second ball cage between the buffer elements.

A three section telescopic rail according to the invention has the advantage that it can be extended over a relatively long distance, wherein the stop block provides for a stop and buffering function of the second and first section, whereas in the fully retracted position the stop block provides for a stop and buffering function for all three sections. The buffer part extending through the second, intermediate rail and providing for buffering means for the third section has the advantage that there is no need for a tab near the rear end of the third section. In the fully retracted position of the second and third sections the third projection, positioned near the front of the third section abuts the resilient means of the buffer part, thus limiting movement of the second section relative to the third section in rearward, retracted direction. The third section can therefore be relatively short compared to the third section of a known telescopic rail with similar possible extension length. The length of the third section can for example be limited to approximately the length of the path of travel of the second ball cage and the length of the second ball cage itself.

A further advantage of a telescopic rail according to the invention in such embodiment is that assembly of this rail is very easy. This can be done for example as follows. The first, second and third sections can be manufactured separately, except for the second, front projection on the first section. The second ball cage and the second section are slid into the third section, after which the stop block is placed in the second section, thus locking the second section to the third section. In the fully extended position the front side of the second ball cage abuts the third projection, a tab near the rear end of the second section abuts the rear side of the second ball cage, thus limiting movement of the second section relative to the third section in forward, extended direction. Afterwards the first section and the first ball cage are slid into the second section from the rear side. Finally the second, front projection on the first section is made when the first section is extended relative to the second section, thus locking the first section in the second section. Therefore only one of the projections has to be provided for when the three sections are assembled, thus reducing the risk of the sections coming apart again during assembling, while eliminating this risk during use. Furthermore, only one manufacturing step has to be taken after positioning of the sections within eachother, thus reducing handling.

The first and second hook means provide for a limitation of forward, extending movement of the first section relative to the second section when they are in their normal position, that is the one in the path of movement of the other. Upon forward movement of the first section the first hook means engage the second hook means, thus preventing further movement of the first section in the forward direction. By actuating the second hook means by movement of at least part thereof, the second hook means, at least the engaging part thereof can be brought out of the normal path of travel thereof, such that in further forward movement of the first section the first and second hook means do not engage each other and the first section can be pulled out of the second section in a forward direction. Thus a telescopic rail according to the invention can be of a disconnect type. The second and/of first hook means can be provided with resilient means for buffering shock when they engage each other.

The co-operating first resilient projection and first engaging means near the front side of the first and second section respectively lock the first section relative to the second section in the at least nearly fully retracted position. The locking force thereof is such that upon pulling the telescopic rail toward the extended position by engaging the first section, the second section will move relative to the third section to a fully extended position, wherein during this movement the first section stays in the same position relative to the second section. Only when the second section has moved over its maximum distance relative to the third section and the ball cage is in abutment with the third projection, the first section will move relative to the second section when the first section is submitted to a further pulling force in forward direction, overcoming said locking force. Thus a telescopic rail according to the invention has a predetermined order of extension; first the second section relative to the third, secondly the first section relative to the second section. In a two-sectioned embodiment the stop block in this embodiment provides also for a locking mechanism.

The second resilient projection on the buffer part and the second engaging means on the third section have the advantage that upon full retraction of the rail the second section is locked into this position. Thus unwanted movement of the second section relative to the third movement is easily prevented. A certain, predeterminable forward force will have to be exerted on the second section in order to disengage the second resilient projection and the second engaging means, in order to be able to obtain extension of the rail. Thereby it is advantageous when the second section is pulled, forced into said fully retracted position by the co-operating second resilient projection and the second engaging means.

In one embodiment of the disclosed telescopic rail, it is especially advantageous when the locking force of the first resilient projection and the first engaging means is greater then the locking force of the second resilient projection and the second engaging means. Such a telescopic will be locked into the fully retracted position and still have said predetermined order of extension.

Further advantageous embodiments of a telescopic rail according to the invention are given in the subclaims, the description and the drawings.

Embodiments of a telescopic rail according to the invention will be further explained and illustrated, by way of example, with reference to the accompanying drawings, in which.

Figure 1:
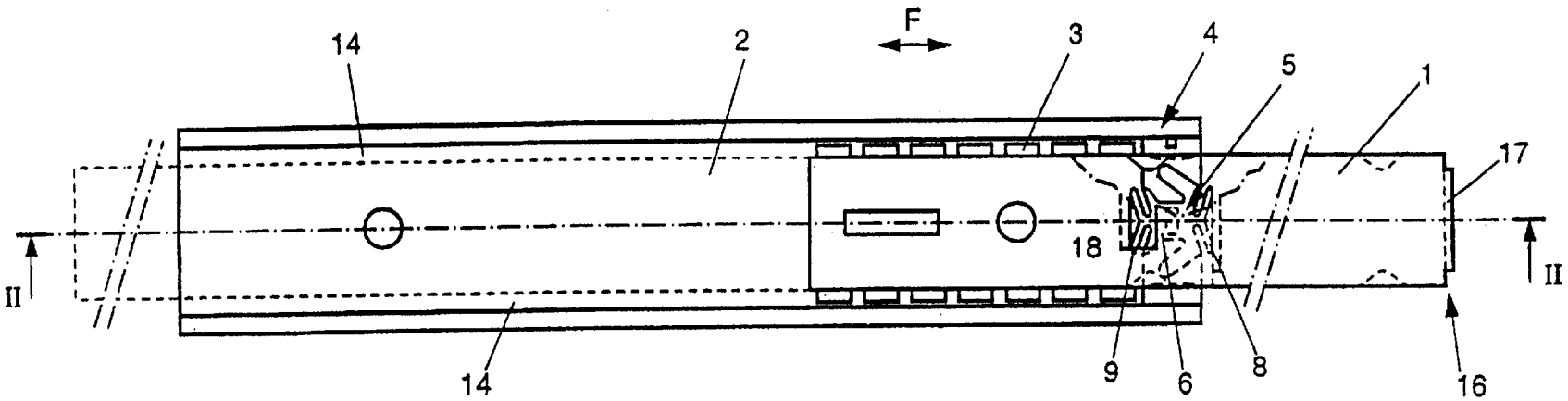
FIG. 1 is an elevational view of a first embodiment of a telescopic rail.
Figure 2:
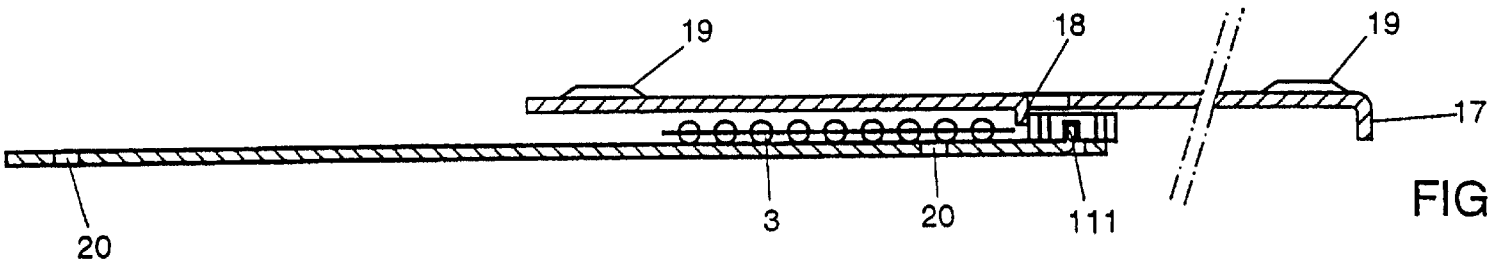
FIG. 2 is a section taken along the line II—II of FIG. 1.

A telescopic rail as shown in FIGS. 1 and 2 consists of a first section 1 and a second section 2, the sections 1 and 2 being extendible between a first and second end position. In FIG. 1 the first section 1 is shown in a fully retracted, first position in dotted lines, and in fully extended, second position in full drawn lines. The direction of extension and retraction is indicated by the arrow F. Mounted between the sections 1 and 2 is a ball cage 3 of a type known per se. The first 1 and second section 2 of the telescopic rail are substantially C-shaped, as shown in FIG. 5A, defining raceways 42 for the balls of the ball cage 3.

Figure 3:
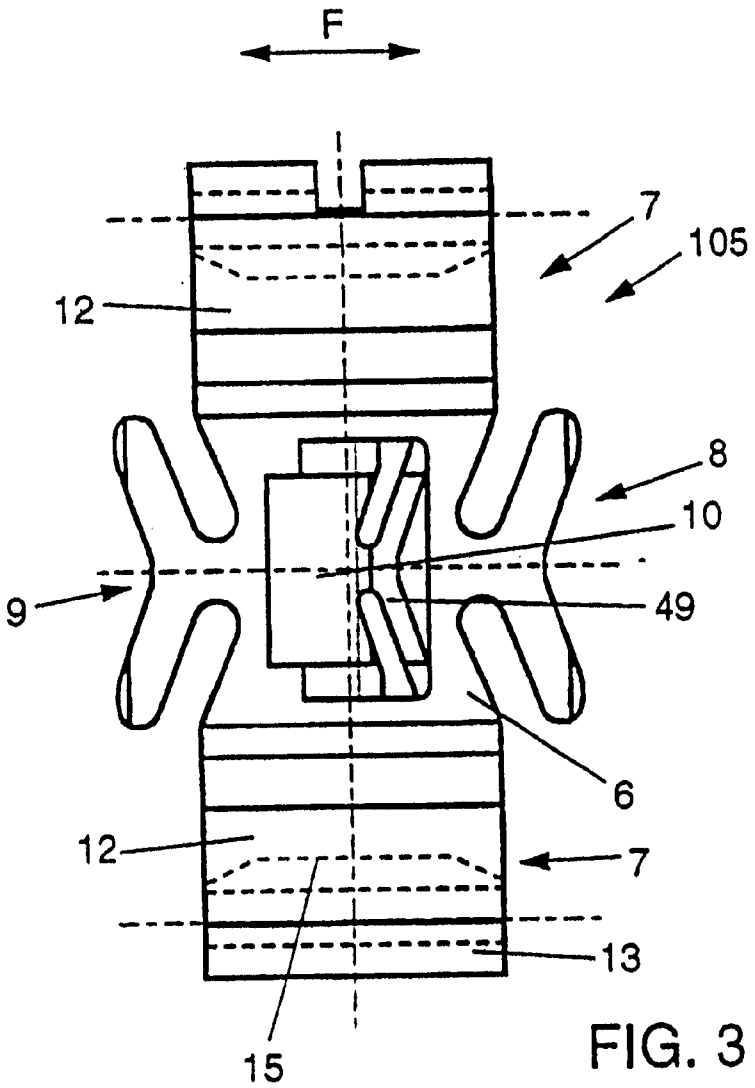
FIG. 3 is an elevational view of a stop block in a first embodiment, seen from the back side.
Figure 10:
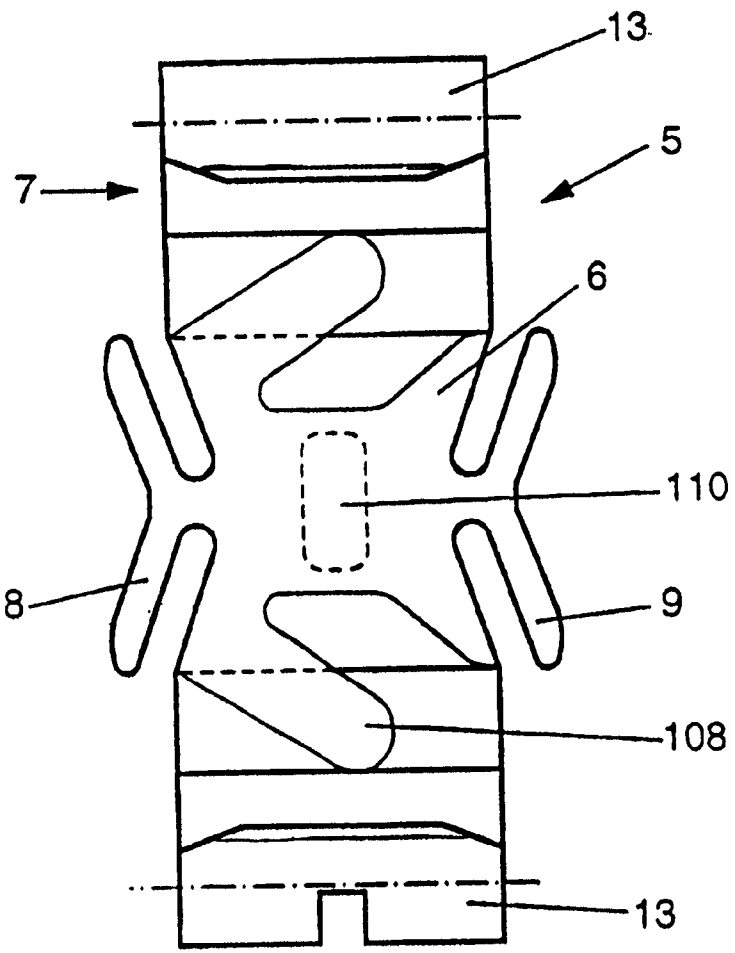
FIG. 10 is an elevational view of a stop-buffer-lockblock, especially for use in a two-sectioned rail.
Figure 4:
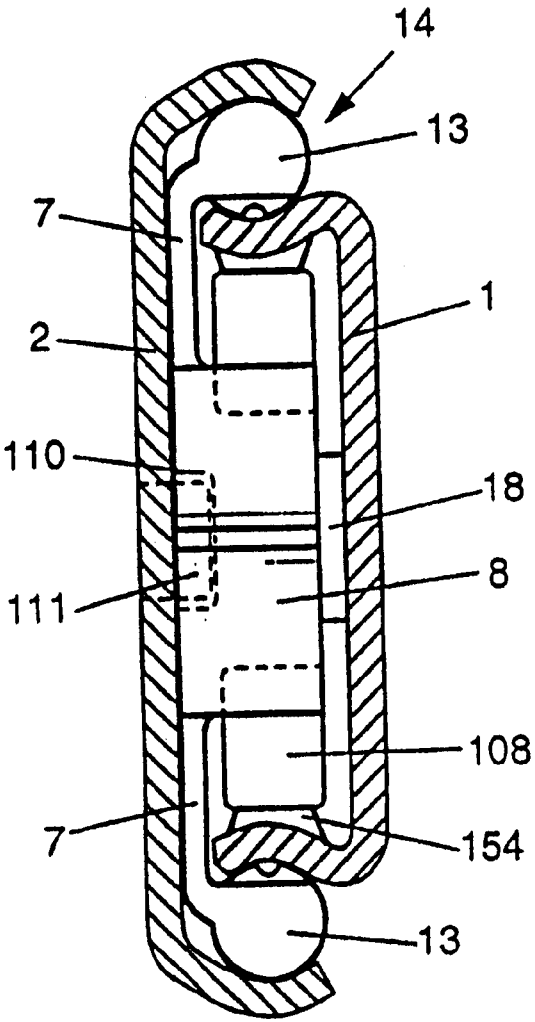
FIG. 4 is a side view of a stop block of FIG. 3.

Near the front end 4 of the second section 2 a stop block 5 is positioned, as more specifically shown in FIGS. 3 and 10. The stop block 5 is provided with a body 6, two wings 7 extending from opposite sides of the body 6 in a direction perpendicular to the direction of extension and retraction F. The stop block 5 furthermore comprises two pairs of flexible finger-like extensions 8, 9, extending from opposite sides of the body 6 in a direction parallel to the direction of extension and retraction F. On the backside of the stop block 5 a recess 110 is formed which can be positioned over a tab 111 on the second section 2 for attachment thereof. Each wing 7 comprises an undulated connecting part 12, terminating in a rod like element 13 positioned in the raceways 14 between the first 1 and second section 2. The rod like elements 13 constitute guide elements for the first 1 and second section 2 upon extension of the telescopic rail, and furthermore provide for centering and stability of the first section 1 relative to the second section 2 in both directions perpendicular to the direction of extension and retraction F, since these rod like elements 13 prevent movement of the first section 1 relative to the second section 2 in any direction other than the direction of extension and retraction F. Each rod like element 13 is provided with a groove 15 extending parallel to the direction of extension and retraction F, on the side facing the raceways 14 of the first section 1. These grooves 15 minimize friction between the stop block 5 and the first section 1, and furthermore provide for means of passage of grease on the raceways 14 of the first section 1, necessary for smooth movement of the first section 1 relative to the second section 2 upon extension or retraction of the telescopic rail.

The resilient finger like extensions 8, 9 projecting from the body 6 form buffer means for the first section 1 in respectively the first and second position thereof. The first end 16 of the first section 1 is provided with an inward facing tab 17. Upon movement of the first section 1 relative to the second section 2 towards the retracted position of the rail, the tab 17 encounters the finger like extensions 8 facing the tab 17. Upon abutment of the extensions 8 and the tab 17 the extensions 8 deform slightly thereby buffering the force of movement of the first section 1, such that the first section 1 reaches the fully retracted position in a smoothly manner. At the opposite side of the stop block 5 the first section 1 is provided with a second inward facing tab 18 which can pass over the ball cage 3. In the fully extended position, as shown in FIGS. 1 and 2 the second tab 18 encounters the second finger like extensions 9 on the relevant side of the stop block 5. Upon abutment of the second tab 18 the second resilient extensions 9 deform slightly thereby buffering the first section 1. Therefore, the first section 1 reaches the fully extended position in an equally smooth way.

The total possible length of extension of the telescopic rail is defined by the distance between the first 17 and second inward facing tab 18 minus the width of the stop block 5 between the first 8 and second extensions 9. Since the second inward facing tab 18 can move: over the ball cage 3 the total length of the first section 1 needs to be no longer than the possible length of extension added to the length of the ball cage 3. Since the stop block 5 is positioned near the first end for of the second section 2, and since both the stop and buffer functions for the extension and retraction of the first section 1 relative to the second section 2 are integrated in this stop block 5, the second section 2 can be relatively short. The length of the second section 2 need not be more than necessary for provision of guidance of the ball cage 3 during retraction or extension of the rail. The possible distance of movement of the ball cage 3 is half the length of the possible movement of the first section 1.

The first section 1 is provided with attachment means 19 for attachment thereon of for example a drawer. The second section 2 is provided with second attachment means 20 for attachment thereof to for example the inside of a cabinet.

Since the stop block 5 and the two inward extending tabs 17, 18 provide for both the buffer means and the stop means of the rail, the buffer cage 3 does not have to be provided with buffer means and is therefore easy to manufacture and relatively inexpensive.

The stop block 5 as shown especially in FIGS. 1, 2, 4 and 10 is on the sides of the body 6 provided with two outward facing resilient fingers 108, enclosing an angle with the direction of extension and retraction F. The first section 1 is near the front end provided with inward facing notches 154 extending into the raceway 14. The fingers 108 are facing backward into the path of travel of the notches 154 into the raceways 14. Therefore, when the first section 1 is brought into the fully retracted position the resilient fingers 108 are positioned in front of the notches 154 thereby enclosing the first section 1 in the retracted position. Upon extension of the rail the notches 154 pass the resilient fingers 108, elasticly deforming them. When brought into the fully retracted position again the fingers 108 are once again bent out of the path of travel of the notches 154. The stop block 5 has thus a locking function besides the stop and buffer function mentioned before.

A telescopic rail according to FIGS. 1 and 2 can be manufactured as follows.

The first and second section 2 are manufactured completely except for bending the first inward facing tab 17 of the first section 1. The stop block 5 is positioned in the second section 2, after which the ball cage 3 and the first section 1 are slid into position within the section 2. Finally the tab 17 is bend to the inward facing position, thus locking the first section 1 within the second section 2.

The stop block 5 could be provided with resilient means on the topside, such that the first tab 17 can be bent before assembling the rail and can be pushed over the stop block 5 into the assembled position but can not pass the stop block 5 in the opposite direction. Thus no manufacturing step is necessary after sliding the sections into place. Such resilient means can be used in any rail according to the invention.

Figure 5:
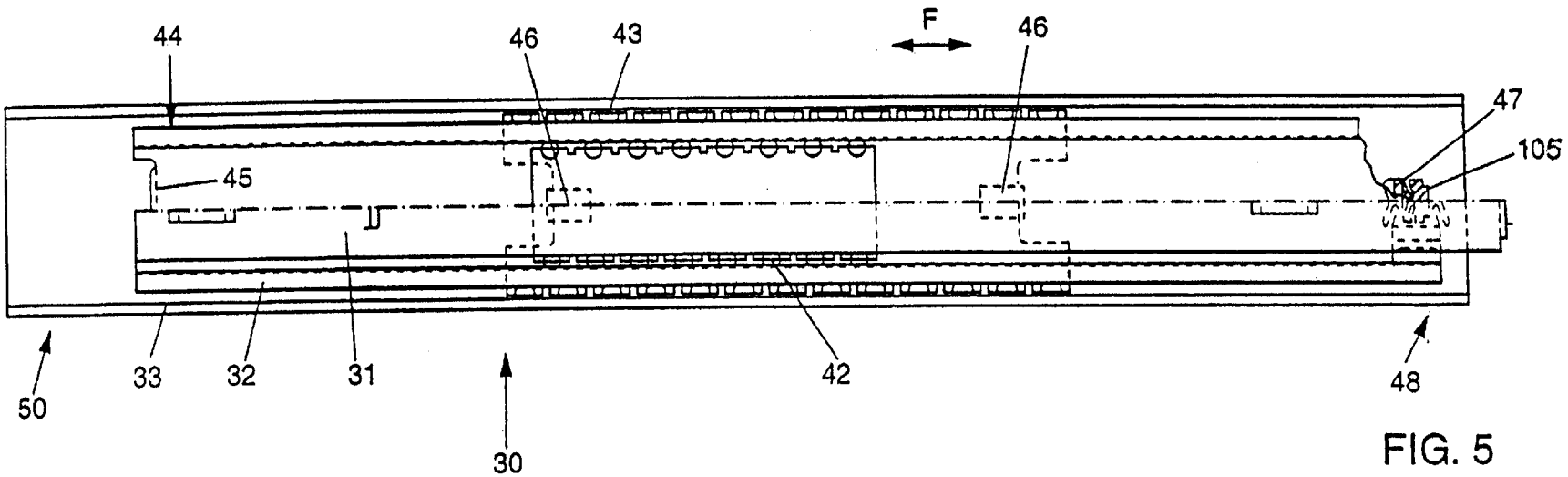
FIG. 5 is an elevational view of a second embodiment of a telescopic rail.
Figure 5A:
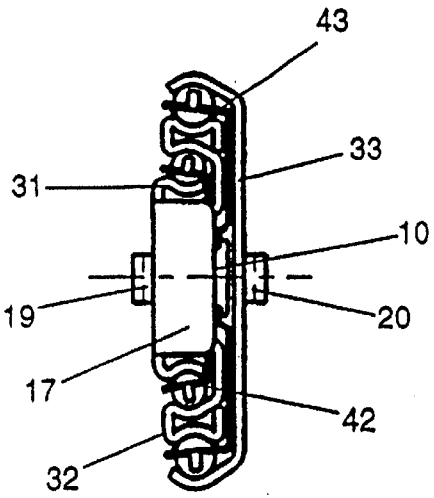
FIG. 5A is a side view of a telescopic rail according to FIG. 5.

FIG. 5 shows a second embodiment of a telescopic rail 30. In this embodiment the telescopic rail 30 comprises a first section 31, a second section 32 and a third section 33, all of substantially C-shaped form. Between the first section 31 and the second section 32 a first ball cage 42 is enclosed, between the second section 32 and the third section 33 a second ball cage 43 is enclosed. The first section 31 is movable relative to the second section 32, the second section 32 relative to the third section 33, all in the direction of extension and retraction F. The first section 31 and second section 32 are comparable though not exactly similar to the first 1 and second section 2 of the first embodiment, as shown in FIGS. 1 and 2. The second end 44 of the second section 32 is provided with a third tab 45 extending in the direction of the third section 33. The second ball cage 43 is provided with buffer means 46 at both the front and rear end thereof. Such a ball cage is known for example from EP 0 488 471 or NL 83,04456, both incorporated herein by reference. However, the invention is not limited to these types of ball cages.

Upon extension of the second section 32 relative to the third section 33 the third tab 45 encounters the rearward buffer element 46 on the second ball cage 43 thus preventing further movement of the second section 32. In this position the front buffer element 46 on the second ball cage 43 is moved against a fourth tab 47 facing inward from the third section near the first end 48 thereof, thus preventing further forward movement of the second section 32 relative to the third section 33. Thus the first section 31 can be extended relative to the second section 32 by forward movement until the second tab 18 on the first section 31 abuts the resilient extensions 9 on the stop block 105, similar to a two sectioned rail as shown in FIGS. 1 and 2. Furthermore, the second section 32 can be extended relative to the third section 33 until the third tab 45 abuts the rear buffer element 46 on the second ball cage 43 whereby the front buffer element 46 abuts the fourth tab 47 on the third section 33.

Figure 6:
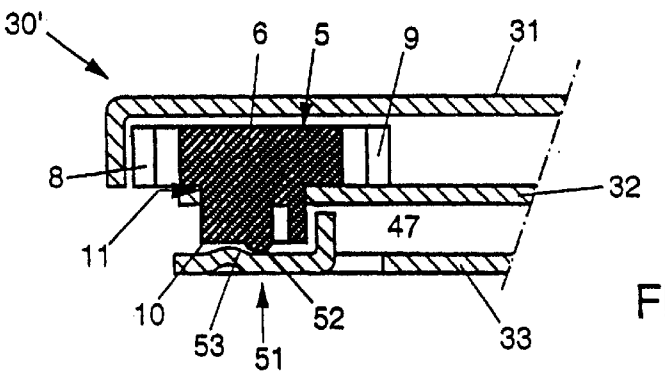
FIG. 6 is an elevational view of a section of a first end of a telescopic rail.

Upon retraction of the first 31 and second section 32 relative to the third section 33, the first, inward facing tab 17 on the first section 31 will abut the first resilient extensions 8 on the stop block 105 thus preventing further inward movement of the first section 31 relative to the second section 32. The retraction movement of the second section 32 relative to the third section 33 is restricted by the fourth tab 47 on the third section 33 and a buffer part 10 on the backside of the stop block 105 (FIG. 3). To this end the,buffer part 10 extends through the aperture 11 in the second section 32, such that the fourth tab 47 is in the path of movement of the buffer part 10 (FIG. 6). At the rearward facing side of the buffer part 10 two resilient buffer fingers 49 are provided, extending parallel to the resilient extensions 8, 9 on the body 6 of the stop block 105. The fingers 49 and the extensions 8, 9 enclose an angle with the direction of extension and retraction F. When the second section 32 is retracted from an extended position, the resilient fingers 49 will encounter the forward facing part of the fourth tab 47 and will deform slightly thus forming a buffer and preventing further retraction movement of the second section 32 relative to the third section 33.

Since the buffer part 10 near the first, forward facing end 48 of the rail and the corresponding fourth tab 47 provide for buffer and stop means for the retraction and extension movement of the second section 32 relative to the third section 33, the third section 33 can be relatively short. A stopping element, normally placed near the rearward end 50 of the third section 33 can be disposed of. Therefore, the length of the third section needs only to provide for the raceway necessary for the second ball cage 43, that is for guidance of the movement thereof between the fully retracted and the fully extended position of the second section 32 relative to the third section 33. Thus a telescopic rail 30 according to this embodiment is relatively light and easy to manufacture.

A telescopic rail 30 in an embodiment according to FIG. 5 can be assembled as follows.

The first 31, second 32 and third section 33 are all manufactured completely, except for bending the first, inward facing tab 17 on the first section 31. Then the second ball cage 43 and the second section 32 are slid into place within the third section 33, from the rearward end 50 thereof and, the second section 32 is moved forward such that the aperture 11 is in front of the fourth tab 47. Then the stop block 105 is brought into position within the second section 32. Then the first ball cage 42 and the first section 31 are slid into place within the second section 32 from the rear end thereof. The first section 31 is slid forward such that the first tab 17 extends in front of the stop block 105, after which the tab 17 is bend inward, thus locking the three sections and the respective ball cages into place.

FIG. 6 shows a section of the front end 48 of a rail according to the invention, having three sections like an embodiment according to FIG. 5. The rail 30' is shown in the fully retracted position. In order to prevent unwanted movement of at least the second section 32 relative to the third section 33 locking means 51 are provided on the stop block 105 and the third section 33. The locking means 51 comprise a resilient notch 52 on the backside of the buffer part 10 and a second notch 53 on the inward facing side of the third section 33. The distance between the fourth tab 47 and the second notch 53 is such that in the fully retracted position, as shown in FIG. 6, the first notch 52 is positioned between said fourth tab 47 and said second notch 53. The second notch 53 is in the path of movement of the first notch 52. Upon extension or retraction of the second section 32 relative to the third section 33, the resilient notch 52 has to pass the second notch 53 thereby deforming slightly. Therefore, for this movement a force, a so-called first locking-unlocking force $L_1$, has to be exerted on the second section 32 such that the second section 32 will be locked into the fully retracted position as shown in FIG. 6 or unlocked from said position. Said locking force is easily overcome by hand.

Figure 6A:
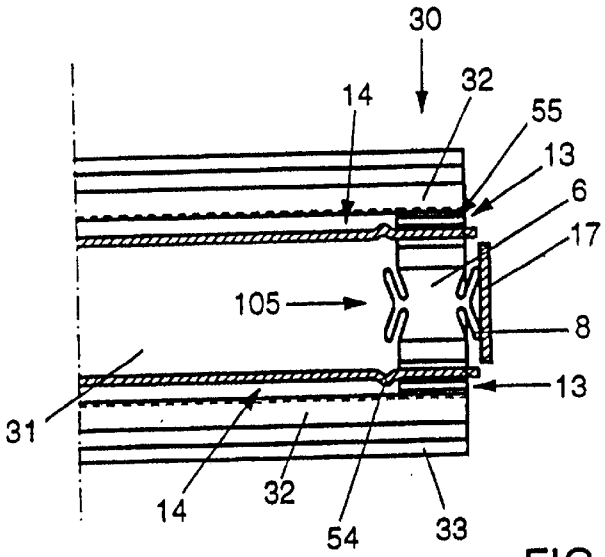
FIG. 6A is a side view of a section of (the first) end of a telescopic rail.

FIG. 6A shows, partly in section, the front end 48 of a rail 30', comparable to an embodiment according to FIG. 5. Corresponding parts have corresponding reference signs.

In this embodiment the first section 31 is provided with two third notches 54 near the front end thereof. The third notches 54 extend into the raceways 14 between the first 31 and second 32 sections. The distance between the inward facing side of the first tab 17 and the third notches 54 corresponds approximately added to the length of the rod like elements 13 and the length of the first resilient extensions 8, seen in the direction of retraction and extension F. When the rail 30' is in the fully retracted position, as shown in FIG. 6A, the third notches 54 are on the rearward side of the rod like elements 13, thus preventing forward movement of the first section 31 relative to the second section 32. The rod like elements 13 are provided with second grooves 55 as is more specifically shown in FIGS. 8 and 9. The second grooves 55 extend through the whole length of the rod like elements 13, and are open to the side facing away from the second 32 and third section 33. Therefore, the rod like elements 13 can be resiliently compressed in a direction approximately perpendicular to the direction of extension and retraction F, thus narrowing the width of the rod like elements 13 within the raceways 14. Therefore, upon exertion of a certain force, a so-called second locking-unlocking force $L_2$ on the first section in the direction of extension, the third notches 54 can be forced passed the rod like elements 13, thus allowing extension of the first section 31 relative to the second section 32. Upon retraction of the first section 31 relative to the second section 32 again the third notches 54 can be forced passed the rod like elements 13, thus locking the first section into the retracted position. Especially, when a rail 30' according to FIG. 6A is also provided with the locking means 51 as shown in FIG. 6, the telescopic rail 30' will have a forced sequence of extension. Preferably, the force $L_1$ necessary for extension of the second section 32 relative to the third section 33 from the fully retracted position is less than the force $L_2$ necessary for extension of the first section 31 relative to the second section 32. In this case, the forced sequence of extension of the telescopic rail 30' will be, upon an extension force, for example $L_2$, exerted on the first section 31, that the first section 31 together with the second section 32 will be extended relative to the third section 33 at first, until the fully extended position thereof is reached, after which the first section 31 will be extended relative to the second section 32 thus bringing the telescopic rail 30' to the fully extended position.

Figure 8:
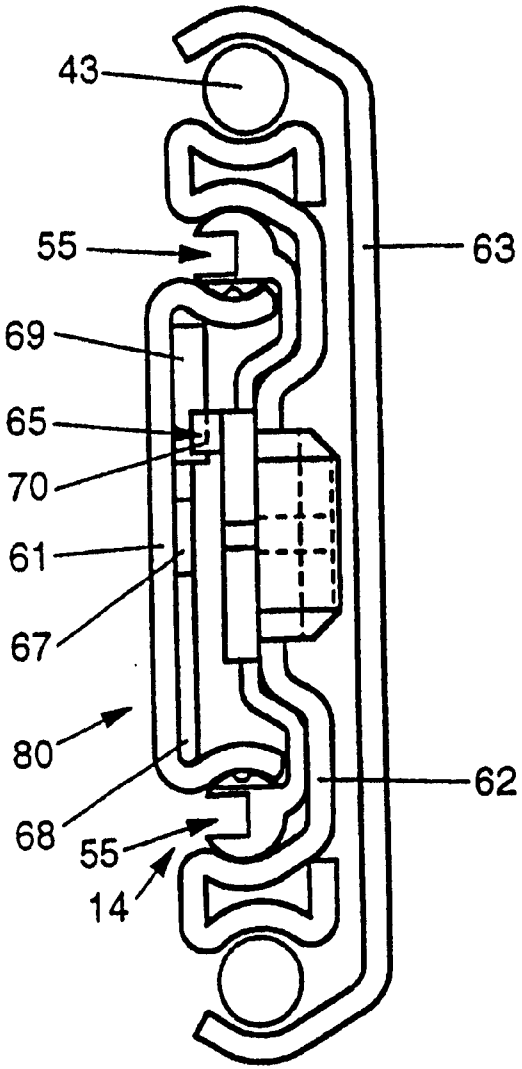
FIG. 8 is an elevational view of a stop block in a second embodiment, seen from the back side.
Figure 7:
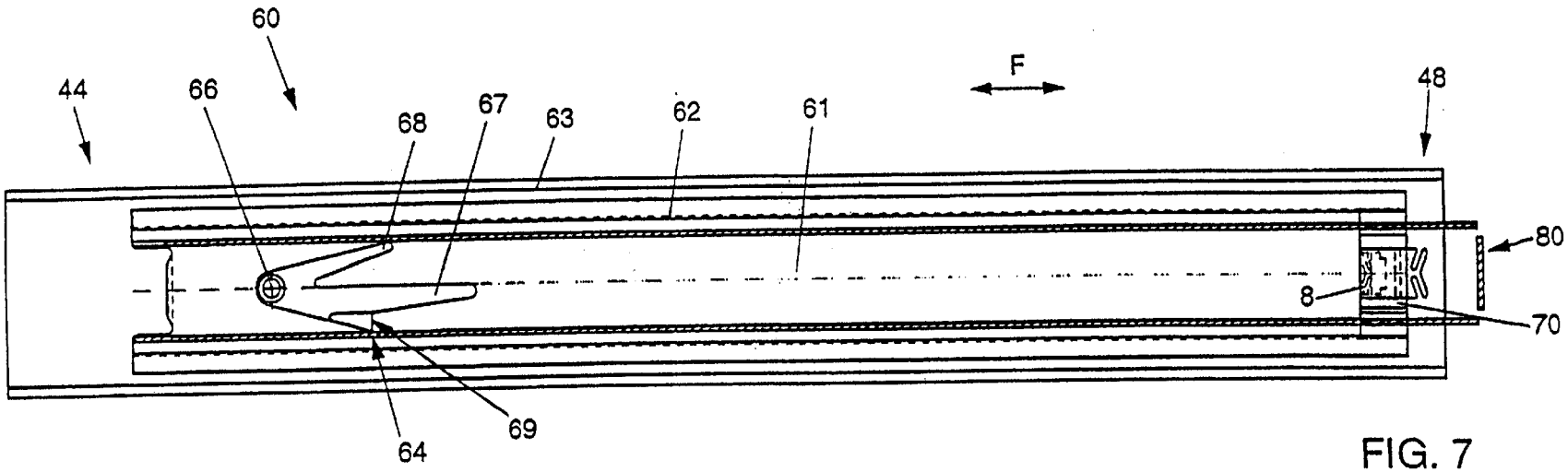
FIG. 7 is a elevational view of a third embodiment of a telescopic rail.

FIG. 7 shows a third embodiment of a telescopic rail 60 according to the invention, again comprising a first 61, second 62 and third section 63, with intermediate first 42 and second ball cage 43. The ball cages are not shown in FIG. 7. The first 61, second 62 and third section 63 are similar to the first 31, second 32 and third section 33 as shown in FIG. 5, except for the second tab 18 on the first section. Instead of this second tab 18 (as shown in FIG. 1) a second hook means 64 is provided within the first section 61, second hook means 65 being positioned on the stop block 80 in a third embodiment, as shown in FIGS. 8. and 9. Corresponding parts have the same reference signs as in the first and second embodiments 5, 105 specifically shown in FIGS. 3, 4 and 10. The first hook means 64 comprises a relatively flat body, attached to the inside of the first section 61 in a first pivot point 66 near the rearward end of the said section 61. Extending from the first pivot point 66 in a forward direction are a lever 67 and a resilient leg 68. The lever 67, is in its normal position, approximately parallel to the direction of the extension and retraction F, the resilient leg 68 enclosing an angle with the lever 67, wherein the free end of the resilient leg 68 is positioned against the inside of the raceway 14 forming part of the first section 61. From the side of the lever 67 opposite to the resilient leg 68 extends an engaging part 69. The second hook means 65 on the stop block 80 comprises a ridge 70 extending along the body 6 of the stop block 80, parallel to the direction of retraction and extension F and perpendicular to the surface 71 of the body 6 of the stop block 80. When the first hook means 64 are in the normal position, as shown in FIG. 7, the second hook means 65, especially the ridge 70 is in the path of travel of the engaging means 69 of the first hook means 64. When the first section 61 is extended relative to the second section 62, the engaging means. 69 will therefore abut against the ridge 70, thus preventing further forward movement of the first section 61 relative to the second section 62. In order to enable further movement in said direction of extension of said section 61 relative to said second section 62 the engaging means 69 will have to be displaced relative to the ridge 70, such that the first 64 and second hook means 65 can pass each other. To this end the forward extending lever 67, which in this extended position of the first section 61 will be easily accessible, will have to be forced in the direction of the resilient leg 68, thereby moving the engaging means 69 in the direction of the resilient leg 68 as well. Since the ridge 70 has a relatively small width B the engaging means 69 will have to be moved only over a relatively short distance, after which the first hook means 64, in particular the engaging means 69 can be moved passed the ridge 70, and thus passed the second hook means 65. Then the first section 61 can be moved forward further relative to the second section 62 and can thus be disconnected. When the lever 67 is released, it will resiliently retract to the normal position as shown in FIG. 7.

Figure 9:
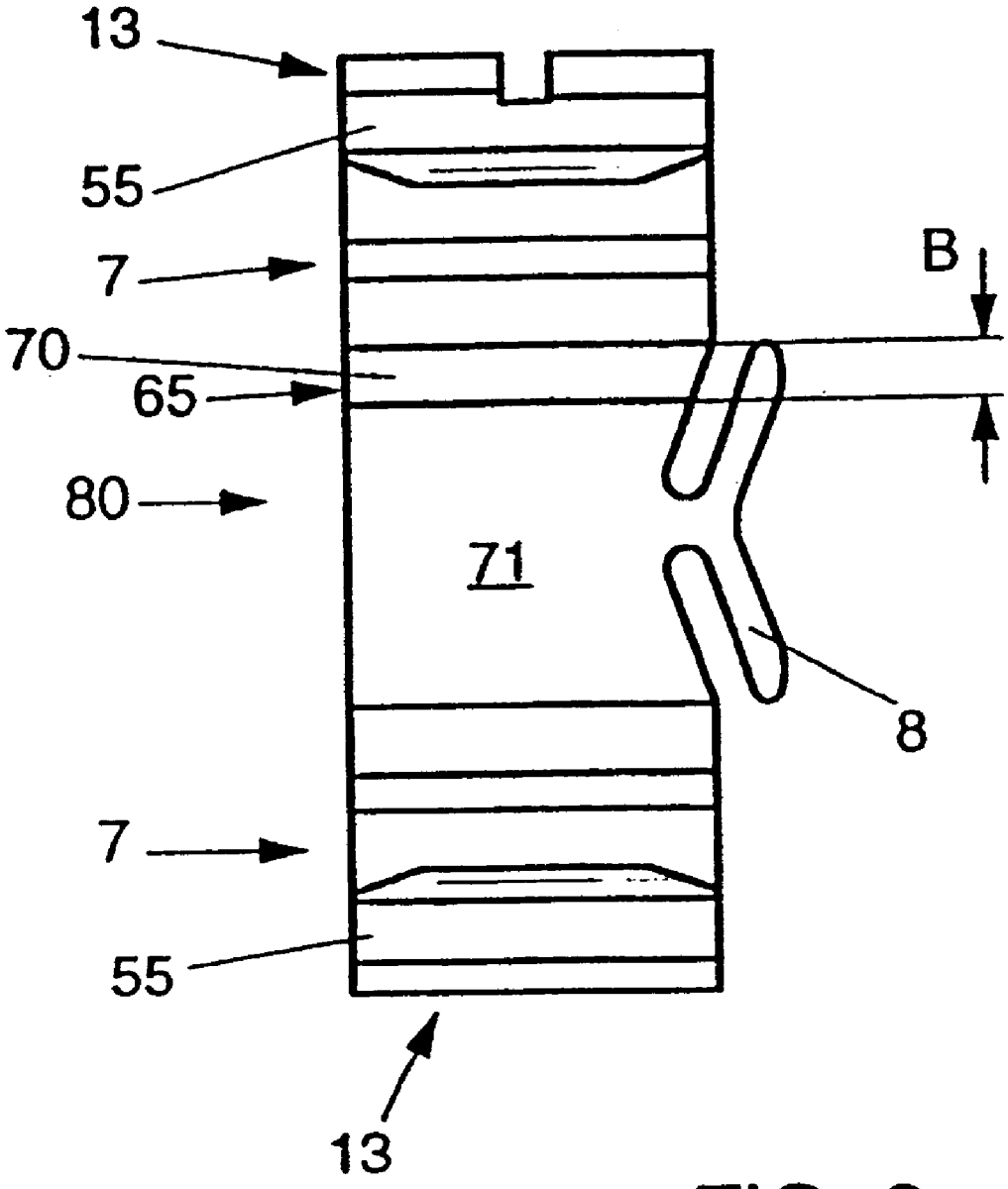
FIG. 9 is a side view of a stop block of FIG. 8.

In order to reposition the first section 61 into the second section 62, the rearward end of the first section 61 will be slid into position from the first end 48 of the second section 62. Automatically the lever 67 and the engaging means 69 of the first hook means 64 will be bend out of the way of the ridge 70, thus enabling further movement of the first section 61 towards the retracted position within the second section 62. The first hook means 64 are somewhat resilient, thus providing for buffer means for extension of the first section relative to the second section 62. The stop block 80, as specifically shown in FIG. 9 is therefore provided with only the forward facing resilient extensions 8.

In a preferred embodiment telescopic rail 60 according to FIG. 7 is provided with locking means 51 as shown in FIG. 6 and/or means for enforcing a sequence of extension as shown in FIG. 6A. When these latter means (FIG. 6A) are used in a two-sectioned telescopic rail as shown in FIGS. 1 and 2, these means will provide for locking means for the first 1 and second section 2.

The invention is by no means limited to the embodiments of a telescopic rail as shown in the drawings or as described in the description. Many modifications and variants are possible within the scope of the invention as defined in the enclosed claims. For example the resilient stop and buffer means on the stop block and/or the buffer part can have different forms, such as fingers enclosing different angles, a deformable part enclosing a deformable chamber, or means of for example relatively compressable material on one or either side of the stop block. The ball cages between the respective sections of a telescopic rail according to the invention can be of a different form or shape. For example, strip like ball cages can be positioned in the respective raceways which strips are not necessarily interconnected. Different types of disconnect means or locking means can be provided on any of the sections. For example, at least one of the rod like members can be provided with an inward extending notch, the first section being provided with a corresponding dent in which said notch can be positioned for locking the first section in the retracted position within the second section. The buffer part can be provided with a dent in its backside, the third section provided with a notch that can be positioned within said dent when the second section is in its fully retracted position, thus locking the second section in this retracted position within said third section. Similar means can be provided for locking the sections in the extended position. All kinds of combinations of the elements described can be used in a rail according to the invention. All kinds of means of attachment for drawers and the like or for attachment of a telescopic rail according to the invention to a cabinet or the like can be used within the scope of the invention. The sections of a telescopic rail according to the invention can have different shapes, the stop blocks to be positioned near the front end of the relevant section by any suitable means. Especially, for the two sectioned embodiments either section can be the so-called drawer-section.

These and similar variants have to be considered as falling within the scope of the invention.

What is claimed is:

1. A rail guide comprising several rails with interposed balls, said rails being telescopically slidable together, forming an outer section, an interposed section, and an inner section, and being substantially U-shaped in cross-section, said balls running in concave sections opposing each other in pairs, characterized in that the outer section carries an elastically deformable element extending within the rail system, said element having at least one protuberance directed transversely to the longitudinal axis of this system, while at the inner section at least one notch directed transversely to the longitudinal axis of the rail system is provided, such that it engages behind the protuberance of the elastically deformable element when the rail guide is in the slid-in position, in which position a force can be exerted on the above element by means provided therefor, said force allowing this element to protrude further in the transverse direction.

2. A rail guide according to claim 1, characterized in that the elastically deformable element has a substantially rectangular cross-section with a front and a back side, as well as with two side faces, an opening for securing the element to a fixed point, in particular at the outer section, being provided near the back side, a hollow space being left near the front side, while adjacent to this hollow space a protuberance directed almost rectangularly to the longitudinal axis of the element is provided at each side face.

3. A rail guide according to claims 1–2, characterized in that each protuberance converges towards the front side of the elastically deformable element in the direction of the longitudinal axis and, on the other side, merges into the respective side face in a rounded way.

4. A rail guide according to claims 1–3, characterized in that the interposed section has an outwardly directed projection which, in the slid-in position of the rail guide, lies against the elastically deformable element and compresses it, while at a distance from the above projection an outwardly directed second projection is provided, which can cooperate with a stop at the inner section.

* * * * *

UNITED STATES PATENT AND TRADEMARK OFFICE

CERTIFICATE OF CORRECTION

PATENT NO. : 6,280,086 B1
DATED : August 28, 2001
INVENTOR(S) : Andreas Petronella Maria Stijns It is certified that error appears in the above-identified patent and that said Letters Patent is hereby corrected as shown below:

Column 1,
Line 48, please insert -- of the sort mentioned in the preamble of claim 1, -- before "in which the said…."

Column 2,
Line 29, "eachother" should read -- each other --

Column 3,
Line 22, "eachother"should read -- each other --.

Column 5,
Line 41, "move:" should read -- move --.
Line 45, "for of" should read -- of --.

Column 6,
Line 20, "bend" should read -- bent --.

Column 7,
Line 8, "the, buffer" should read -- the buffer --.
Line 49, "bend" should read -- bent --.

Column 9,
Line 20, "means." should read -- means --.
Line 45, "bend"should read -- bent --.

Signed and Sealed this

Eleventh Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,280,086 B1 
DATED : August 28, 2001
INVENTOR(S) : Andreas Petronella Maria Stijns It is certified that error appears in the above-identified patent and that said Letters Patent is hereby corrected as shown below:

Columns 9 and 10, should be deleted, and substitute therefor columns 9 and 10 (claims 1-4, as corrected), as shown on the attached page.

Signed and Sealed this

Fifteenth Day of November, 2005

JON W. DUDAS
*Director of the United States Patent and Trademark Office* attached to the inside of the first section 61 in a first pivot point 66 near the rearward end of the said section 61. Extending from the first pivot point 66 in a forward direction are a lever 67 and a resilient leg 68. The lever 67, is in its normal position, approximately parallel to the direction of the extension and retraction F, the resilient leg 68 enclosing an angle with the lever 67, wherein the free end of the resilient leg 68 is positioned against the inside of the raceway 14 forming part of the first section 61. From the side of the lever 67 opposite to the resilient leg 68 extends an engaging part 69. The second hook means 65 on the stop block 80 comprises a ridge 70 extending along the body 6 of the stop block 80, parallel to the direction of retraction and extension F and perpendicular to the surface 71 of the body 6 of the stop block 80. When the first hook means 64 are in the normal position, as shown in FIG. 7, the second hook means 65, especially the ridge 70 is in the path of travel of the engaging means 69 of the first hook means 64. When the first section 61 is extended relative to the second section 62, the engaging means 69 will therefore abut against the ridge 70, thus preventing further forward movement of the first section 61 relative to the second section 62. In order to enable further movement in said direction of extension of said section 61 relative to said second section 62 the engaging means 69 will have to be displaced relative to the ridge 70, such that the first 64 and second hook means 65 can pass each other. To this end the forward extending lever 67, which in this extended position of the first section 61 will be easily accessible, will have to be forced in the direction of the resilient leg 68, thereby moving the engaging means 69 in the direction of the resilient leg 68 as well. Since the ridge 70 has a relatively small width B the engaging means 69 will have to be moved only over a relatively short distance, after which the first hook means 64, in particular the engaging means 69 can be moved passed the ridge 70, and thus passed the second hook means 65. Then the first section 61 can be moved forward further relative to the second section 62 and can thus be disconnected. When the lever 67 is released, it will resiliently retract to the normal position as shown in FIG. 7.

In order to reposition the first section 61 into the second section 62, the rearward end of the first section 61 will be slid into position from the first end 48 of the second section 62. Automatically the lever 67 and the engaging means 69 of the first hook means 64 will be bend out of the way of the ridge 70, thus enabling further movement of the first section 61 towards the retracted position within the second section 62. The first hook means 64 are somewhat resilient, thus providing for buffer means for extension of the first section relative to the second section 62. The stop block 80, as specifically shown in FIG. 9 is therefore provided with only the forward facing resilient extensions 8.

In a preferred embodiment a telescopic rail 60 according to FIG. 7 is provided with locking means 51 as shown in FIG. 6 and/or means for enforcing a sequence of extension as shown in FIG. 6A. When these latter means (FIG. 6A) are used in a two-sectioned telescopic rail as shown in FIGS. 1 and 2, these means will provide for locking means for the first 1 and second section 2.

The invention is by no means limited to the embodiments of a telescopic rail as shown in the drawings or as described in the description. Many modifications and variants are possible within the scope of the invention as defined in the enclosed claims. For example the resilient stop and buffer means on the stop block and/or the buffer part can have different forms, such as fingers enclosing different angles, a deformable part enclosing a deformable chamber, or means of for example relatively compressable material on one or either side of the stop block. The ball cages between the respective sections of a telescopic rail according to the invention can be of a different form or shape. For example, strip like ball cages can be positioned in the respective raceways which strips are not necessarily interconnected. Different types of disconnect means or locking means can be provided on any of the sections. For example, at least one of the rod like members can be provided with an inward extending notch, the first section being provided with a corresponding dent in which said notch can be positioned for locking the first section in the retracted position within the second section. The buffer part can be provided with a dent in its backside, the third section provided with a notch that can be positioned within said dent when the second section is in its fully retracted position, thus locking the second section in this retracted position within said third section. Similar means can be provided for locking the sections in the extended position. All kinds of combinations of the elements described can be used in a rail according to the invention. All kinds of means of attachment for drawers and the like or for attachment of a telescopic rail according to the invention to a cabinet or the like can be used within the scope of the invention. The sections of a telescopic rail according to the invention can have different shapes, the stop blocks to be positioned near the front end of the relevant section by any suitable means. Especially, for the two sectioned embodiments either section can be the so-called drawer-section.

These and similar variants have to be considered as falling within the scope of the invention.

What is claimed is:

1. A telescopic rail, comprising at least two substantially C-shaped sections of which a first section is slidably mounted in a second section with interposition of a first ball cage, characterized in that a stop block is positioned in said second section, in front of the first ball cage seen in the direction of extension of the rail, the stop block having first resilient means near the side facing the first ball cage which can be brought into contact with a first inward facing projection on the first section upon extension of the rail, and second resilient means on the opposite side of the stop block which can be brought into contact with a second inward facing projection on the first section upon retraction of the rail, the first and second projections being located on opposite sides of the first ball cage when the rail is fully retracted, the first projection being movable past the first ball cage.

2. A telescopic rail according to claim 1, characterized in that the stop block is positioned near the front side of said second section.

3. A telescopic rail according to claim 1 or 2, characterized in that the stop block is provided with at least one guide projection positioned between the first and second section and in abutment with facing raceways of said first and second sections, such that upon movement of the first section relative to the second section said sections are guided by the or each said guide projection, the or each guide projection preventing movement in a direction perpendicular to the direction of extension and retraction of the rail.

4. A telescopic rail according to claim 1, characterized in that the first and/or the second resilient means comprise at least one resilient projection inclined relative to the direction of extension and retraction of the rail.

* * * * *